US007633476B2

(12) United States Patent
Sakaguchi

(10) Patent No.: US 7,633,476 B2
(45) Date of Patent: Dec. 15, 2009

(54) DISPLAY ELEMENT DRIVE UNIT, DISPLAY DEVICE INCLUDING THE SAME, AND DISPLAY ELEMENT DRIVE METHOD

(75) Inventor: Nobuhisa Sakaguchi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 781 days.

(21) Appl. No.: 11/240,464

(22) Filed: Oct. 3, 2005

(65) Prior Publication Data

US 2006/0071892 A1 Apr. 6, 2006

(30) Foreign Application Priority Data

Oct. 4, 2004 (JP) ..... 2004-291888

(51) Int. Cl.
*G09G 3/36* (2006.01)

(52) U.S. Cl. ..... 345/89; 345/87; 345/93; 345/94; 345/98; 345/100

(58) Field of Classification Search ..... 345/87, 345/89–100
See application file for complete search history.

(56) References Cited

U.S. PATENT DOCUMENTS

| | | | | |
|---|---|---|---|---|
| 6,462,725 | B1 | 10/2002 | Orisaka | |
| 2001/0003431 | A1 | 6/2001 | Nakao | |
| 2003/0052851 | A1 | 3/2003 | Yano et al. | |
| 2003/0132906 | A1 * | 7/2003 | Tanaka et al. | 345/89 |
| 2004/0174322 | A1 | 9/2004 | Kim et al. | |
| 2004/0196278 | A1 * | 10/2004 | Kida et al. | 345/211 |
| 2004/0239694 | A1 | 12/2004 | Takeda et al. | |
| 2005/0001825 | A1 | 1/2005 | Huang | |
| 2005/0179630 | A1 * | 8/2005 | Huang | 345/87 |
| 2007/0126724 | A1 | 6/2007 | Huang | |

FOREIGN PATENT DOCUMENTS

| | | |
|---|---|---|
| JP | 02-272490 | 11/1990 |
| JP | 04-204993 (A) | 7/1992 |
| JP | 08-146379 | 6/1996 |
| JP | 08-304760 | 11/1996 |
| JP | 09-230832 | 9/1997 |
| JP | 10-232652 | 9/1998 |
| JP | 10-319916 | 12/1998 |
| JP | 2001-013478 (A) | 1/2001 |
| JP | 2001-027750 (A) | 1/2001 |
| JP | 2001-166751 (A) | 6/2001 |

(Continued)

*Primary Examiner*—Richard Hjerpe
*Assistant Examiner*—Saifeldin Elnafia
(74) *Attorney, Agent, or Firm*—Harness, Dickey & Pierce, PLC

(57) ABSTRACT

A display element drive unit is provided with a power-on time display section which separately presets grayscale display digital data to output a grayscale display level voltage different from a grayscale display level voltage based on incoming display data signal to the display elements during a given period between power-on of the display panel and output of the grayscale display level voltage based on the incoming display data signal. With this arrangement, the present invention provides a display element drive unit capable of easing an instantaneous display of distorted image that occurs in a given period at power-on of the panel while minimizing increase of a circuit scale; a display device including the display element drive unit; and a display element drive method.

22 Claims, 16 Drawing Sheets

FOREIGN PATENT DOCUMENTS

| | | |
|---|---|---|
| JP | 2004-4244 (A) | 1/2004 |
| JP | 2004-191697 (A) | 7/2004 |
| TW | 594662 | 6/2004 |
| TW | 223227 | 11/2004 |
| WO | WO 03/001494 | 1/2003 |

* cited by examiner

DIRECTLY INSERT RESET SIGNAL INTO S-TYPE FLIP-FLOP AND FORCEFULLY FIX INTERNAL DATA TO "H" DURING RESET PERIOD

DISPLAY ELEMENT DRIVE UNIT, DISPLAY DEVICE INCLUDING THE SAME, AND DISPLAY ELEMENT DRIVE METHOD

This Nonprovisional application claims priority under 35 U.S.C. § 119(a) on Patent Application No. 291888/2004 filed in Japan on Oct. 4, 2004, the entire contents of which are hereby incorporated by reference.

FIELD OF THE INVENTION

The present invention relates to a display element drive unit which drives a plurality of display elements such as liquid crystal display elements, a display device including the display element drive unit, and a display element drive method. Examples of the display device include: an active-matrix liquid crystal display device; an electrophoretic display; a twist ball display; a reflective display using a fine prism film; a display using light modulation device such as a digital mirror device; a display using an element having a variable luminance of light, such as organic light-emitting display, inorganic light-emitting display, LED (Light Emitting Diode); a field emission display (FED); and a plasma display.

BACKGROUND OF THE INVENTION

Among liquid crystal display devices of various display schemes, there is an active-matrix liquid crystal display device using a TFT (Thin Film Transistor) for a switching element, as a liquid crystal display device capable of providing display with high resolution.

As illustrated in FIG. 13, an active-matrix liquid crystal display device 110 is broadly divided into a liquid crystal display section 110*a* and a liquid crystal drive circuit 110*b* serving as a liquid crystal drive unit which drives the liquid crystal display section 110*a*.

The liquid crystal display section 110*a* has a TFT liquid crystal panel 101. The liquid crystal drive circuit 110*b* includes a source driver 103 and a gate driver 104 each of which is realized by IC (Integrated Circuit; semiconductor integrated circuit), a controller 105, and a liquid crystal drive power source 106.

In the liquid crystal display device 110 of the above arrangement, externally supplied display data is supplied as display data D, which is a digital signal, through the controller 105 to the source driver 103. The source driver 103 latches the supplied display data D by time division into first to n-th source drivers. Thereafter, the source driver 103 performs D/A (digital/analogue) conversion on the time-divided display data D into an analogue voltage for grayscale display (hereinafter, referred to as "grayscale display voltage") in synchronism with a horizontal synchronizing signal fed from the controller 105. Then, the source driver 103 outputs the grayscale display voltage via source signal lines (not shown) to the respective liquid crystal display elements in the liquid crystal panel 101.

Meanwhile, as illustrated in FIG. 14, the liquid crystal panel 101 includes a pixel electrode 111, a pixel capacity 112, a TFT (Thin film Transistor) 113 which performs on/off controls for voltage application to the pixel electrode, a source signal line 114, a gate signal line 115, and a counter electrode 102. Here, the pixel electrode 111, the pixel capacity 112, and the TFT 113 make up a liquid crystal display element A that represents one pixel.

To the source signal lines 114, the grayscale display voltages responsive to luminance levels of target pixels are fed from the source driver 103 illustrated in FIG. 13. To the gate signal lines 115, scanning signals sequentially turning on the TFTs 113 aligned in rows are fed from the gate driver 104. Then, via the ON-state TFT 113, the grayscale display voltage of the source signal line 114 is applied to the pixel electrode 111, which is connected to a drain of the corresponding TFT 113, and the grayscale display voltage is accumulated in the pixel capacity 112, which is provided between the pixel electrode 111 and the counter electrode 102. In this manner, light transmittance of the liquid crystal varies with the grayscale display voltage for display of a pixel.

Next, an n-th source driver that is one of the constituent elements making up the source driver 103 will be described with reference to FIG. 15.

As illustrated in FIG. 15, in an n-th source driver 130, the incoming display data D, digital signal, has display data (DR, DG, DB) of R (red), G (green), and B (blue). The display data D is temporarily latched by an input latch circuit 131, and then stored in a sampling memory circuit 133 by time division, in accordance with operation of a shift register circuit 132 which shifts with a start pulse SP and a clock CK from the controller 105. Thereafter, the display data D is transferred to a hold memory circuit 134 at one time in accordance with a horizontal synchronizing signal (not shown) from the controller 105. "S" in FIG. 15 is cascade output.

A grayscale display reference voltage generator circuit 139 generates reference voltages of different levels in accordance with a voltage VR fed from an external reference voltage generator circuit (equivalent to the liquid crystal drive power source 106 illustrated in FIG. 13). Data of the hold memory circuit 134 is transmitted through a level shifter circuit 135 to a D/A converter circuit 136 to convert them into analogue voltages in accordance with reference voltages of difference levels. Then, an output circuit 137 causes liquid crystal drive voltage output terminals 138 (terminals R1, G1, B1-Rn, Gn, Bn represented in FIG. 15) to output the converted analogue voltages as the grayscale display voltages to the source signal lines 114 of the liquid crystal display elements A. That is, the number of the reference voltage levels indicates the number of grayscale levels.

The grayscale display reference voltage generator circuit 139 which generates the foregoing reference voltages to generate intermediate voltages generates, for example, 64 levels of reference voltages, as illustrated in FIG. 16.

The grayscale display reference voltage generator circuit 139 is composed of: nine halftone voltage input terminals represented by V0, V8, V16, V24, V32, V40, V48, V56, and V64; resistor elements R0 through R7 having resistance ratio for γ correction; a total of 64 resistors including groups of 8 resistors connected across each of the resistor elements R0 through R7. In this manner, the source driver 103 includes resistance ratio called γ correction so that liquid crystal drive output voltages for converting into the grayscale display voltages have broken line characteristic. Consequently, optical characteristics of liquid crystal material are corrected by using the resistance ratio, so that natural grayscale displays can be provided according to the optical characteristics of the liquid crystal material. FIG. 17 illustrates an example of characteristics of γ-corrected liquid crystal drive output voltages in the conventional grayscale display reference voltage generator circuit 139.

Next, the gate driver 104, as illustrated in FIG. 18, includes a control logic 161, a bidirectional shift register 162, a level shifter 163, an output circuit 164, and others. The gate driver 104 includes terminals for receiving a start pulse signal SP, a clock signal CK, a power-supply voltage VCC, a ground voltage GND, and voltage VDD, and multiple output terminals OS1 through OSn.

The control logic 161 generates a signal required for operation of the bidirectional shift register 162 and then supplies the generated signal to the bidirectional shift register 162. When receiving the clock signal CK and the start pulse signal SP, the bidirectional shift register 162 carries out a shift operation to sequentially bring the start pulse signal SP into sync with the clock signal CK. The bidirectional shift register 162 generates a select pulse and then outputs it to the level shifter 163. The select pulse is the one for selecting from the liquid crystal panel 101 a pixel electrode to be driven by voltage applied from the source driver 103 to the source signal line 114. The level shifter 163 converts a voltage of the select pulse into a voltage at a level required for on/off (selected/non-selected) of the TFT element 113 in the liquid crystal panel 101, and outputs it to an output circuit 164.

In accordance with the signal fed from the level shifter 163, the output circuit 164 applies a voltage at a level required for on/off of the TFT element 113, via the respective output terminals OS1 through OSn, to the gate signal lines 115. That is, as illustrated in FIG. 19, for example, when the output circuit 164 receives an input signal of voltage VCC, the output circuit 164 sequentially supplies an output signal of voltage VDD to the output terminals OS1 through OSn. On the other hand, when the output circuit 164 receives no input signal (voltage GND), the output circuit 164 supplies an output signal of voltage. VSS to the output terminals OS1 through OSn.

Incidentally, in such a conventional display element drive unit, all display control input signals are supplied through the controller 105 illustrated in FIG. 13. Therefore, in a state of the display element drive unit right after a panel running power is turned on but before operation of the controller is initiated, since neither display data signal nor input control signal are supplied respectively to the source driver 103 and the gate driver 104 both of which are illustrated in FIG. 13, voltages of the driver output terminals supplied to the liquid crystal panel 101 are in unstable levels.

For this reason, due to voltage levels of gate elements on the panel at power-on, unstable voltages are added to the source voltages. This might cause instantaneous unexpected displays on part of the scanning lines or over the entire panel.

In order to avoid such a phenomenon, Japanese Laid-Open Patent Application No. 4244/2004 (Tokukai 2004-4244; published on Jan. 8, 2004), for example, adopts a technique of outputting another given voltage to a panel electrode or an external counter electrode CS by a switch of output switch means which is provided between grayscale selection means (D/A converter) and a liquid crystal panel electrode.

However, in the conventional display element drive unit, since a technique of Japanese Laid-Open Patent Application No. 4244/2004 has a necessity for reducing resistance of switch means (analogue switch or the like) to prevent a voltage drop of the grayscale display voltage, it has the problem of an extremely large circuit area for switch means (analogue CMOS or the like) which switches to an analogue voltage converted by the D/A converter.

More specifically, in the arrangement having the voltage level switch means realized by an analogue switch as illustrated in FIG. 20, in a display element drive unit, a D/A converter 201 generally converts the display data into analogue grayscale select voltage, and an output circuit 202 using an operational amplifier circuit, for example, causes the analogue grayscale select voltage to have low impedance so as to output analogue voltage as a liquid crystal pixel source voltage A.

At the point, in the case where the arrangement of Japanese Laid-Open Patent Application No. 4244/2004 is adopted, for example, provision of a switch 210 for supply of a pixel voltage to a counter electrode is considered as illustrated in FIG. 20 to apply a given voltage to a liquid crystal pixel or output it to an external counter electrode CS during a given period right after the power-on.

However, in the arrangement where the switch 210 is provided at the subsequent stage of the output circuit 202 in which the analogue grayscale select voltage resulting from analogue conversion is subjected to low-impedance processing, a resistance impedance is applied to the liquid crystal pixel source voltage A that is an analogue voltage having a low impedance, before reach to the corresponding pixel. Since this resistance impedance component affects, for example, analogue time constant, transient characteristic, or a pixel voltage switching speed such as a voltage drop caused due to a delay of a reach time with increase in slew rate, it is necessary to design an extremely low on-resistance of the analogue switch section 211 according to panel characteristics. Therefore, in the arrangement in which this switch is realized by an analogue circuit which needs to withstand a voltage to some extent, a transistor of large size has to be designed with a design of low on-resistance. This causes a relative increase in circuit scale.

in addition, in order that the switch 210 inversely outputs a common voltage to supply it to a common electrode, an analogue switch section 211 needs to be of a buffer having an ability to cause a common voltage to make a transient response, and needs to be of a low impedance. Therefore, it is necessary to decrease a circuit impedance according to a drive performance of the common electrode, which thus causes a relative increase in circuit scale.

SUMMARY OF THE INVENTION

An object of the present invention is to provide: a display element drive unit capable of easing a instantaneous display of distorted image that occurs in a given period at power-on of a panel while minimizing increase of a circuit scale; a display device including the display element drive unit; and a display element drive method.

In order to achieve the above object, a display element drive unit of the present invention is a display element drive unit which drives a display panel including a plurality of display elements so that the display panel provides a display, the display element drive unit comprising: a power-on time display section which separately presets grayscale display digital data to output a grayscale display level voltage different from a grayscale display level voltage based on incoming display data signal to the display elements during a given period between power-on of the display panel and output of the grayscale display level voltage based on the incoming display data signal.

In order to solve the above problem, a display element drive method of the present invention is a display element drive method for driving a display panel including a plurality of display elements so that the display panel provides a display, wherein: during a given period between power-on of the display panel and output of a grayscale display level voltage based on incoming display data signal, grayscale display digital data is separately preset and converted into analogue grayscale display level voltage to output the analogue grayscale display level voltage to the display elements.

That is, due to gate voltage levels of the display element on the display panel, unstable voltages are added to the source voltages. This might cause instantaneous unexpected displays on part of the scanning lines or over the entire display panel.

As a measure for preventing this phenomenon, such a measure is considered to be taken that a given voltage is provided separately to an analogue switch section provided between the display element drive unit and the display panel. However, this measure requires reduction in resistance of the analogue switch section to prevent a voltage drop of a grayscale display voltage. This extremely increases a circuit area of the analogue switch section.

In view of this, in the present invention, the power-on time display section separately presets grayscale display digital data to output a grayscale display level voltage different from a grayscale display level voltage based on incoming display data signal to the display elements during a given period between power-on of the display panel and output of the grayscale display level voltage based on the incoming display data signal.

Therefore, in the present invention, a digital section basically fixes the separately preset grayscale display digital data during an unstable display period at the power-on. This makes a circuit configuration designed in a digital manner. Thus, it is possible to design a circuit configuration further smaller than that of the switch section realized by an analogue circuit.

A D/A converter circuit is used in the conventional manner, which does not affect drive performance of analogue output.

Consequently, it is possible to provide: a display element drive unit capable of easing an instantaneous display of distorted image that occurs in a given period at power-on of the panel while minimizing increase of a circuit scale; and a display element drive method.

Further, a display element drive unit of the present invention, in the foregoing display element drive unit, includes: a transfer section which transfers a start pulse signal based on a clock signal; a latch section which receives incoming display data signal in synchronism with the clock signal and then outputs the incoming display data signal as synchronization data; a sampling section which samples the synchronization data in accordance with the transferred start pulse signal and then outputs the sampled synchronization data; a level shift section which increases a voltage of the sampled synchronization data; a digital analogue converter section which carries out digital-analogue conversion of digital data outputted from the sampling section; and an output section which outputs a grayscale display-use analogue voltage obtained by the digital-analogue converter section to the display elements, and the power-on time display section includes: a power-on time judgment section which judges power-on of the display panel; a switch section which switches between the separately preset grayscale display digital data and grayscale display digital data based on the incoming display data signal; and a switch control section which controls, in accordance with the judgment of power-on by the power-on time judgment section, switch between the separately preset grayscale display digital data and the grayscale display digital data based on the incoming display data signal by the switch section.

According to the present invention, the power-on time display section is provided in front of the level shift section. This arrangement makes the digital section to basically fix the separately preset grayscale display digital data during an unstable display period at the power-on. Consequently, it is possible to minimize a circuit increase by providing the power-on time display section for a low voltage drive section that drives with 3V to 5V power voltage at the previous stage of the level shift section.

The arrangements of the transfer section for transferring a start pulse signal based on a clock signal, the latch section, the sampling section, the level shift section, the digital-analogue converter section, and the output section are the same as the arrangement of the conventional display element drive unit. Therefore, it is possible to solve the problem of an instantaneous display at the power-on while maintaining the installation of the existing periphery components of the panel.

Further, the power-on time display section includes: (a) the power-on time judgment section which judges power-on of the display panel; (b) the switch section which switches between the separately preset grayscale display digital data and grayscale display digital data based on incoming display data signal; and (c) the switch control section which controls, in accordance with the judgment of power-on by the power-on judgment section, the switch between the separately preset grayscale display digital data and the grayscale display digital data based on the incoming display data signal performed by the switch section.

Therefore, it is possible to provide a specific arrangement of the power-on time display section.

The digital-analogue converter section which carries out digital-analogue conversion is generally realized by the grayscale display reference voltage generator circuit and an adjustment amplifier so as to generate a desired intermediate voltage. Therefore, a display voltage at the power-on is outputted in accordance with the conventional grayscale conversion scheme. Consequently, it is possible to reduce a circuit scale and terminals count, thus reducing the cost of manufacture.

Further, in order to solve the above problem, a display device of the present invention includes the foregoing display element drive unit.

According to the above invention, it is possible to provide a display device including the display element drive unit capable of easing an instantaneous display of distorted image that occurs in a given period at power-on of the panel while minimizing increase of a circuit scale.

The following description will sufficiently clarify further objects, characteristics, and excellent points of the present invention. Further, advantages of the invention will be clarified with reference to the ensuing detailed description taken in conjunction with the accompanying drawings.

DESCRIPTION OF THE EMBODIMENTS

The following will describe one embodiment of the present invention with reference to FIGS. 1 through 12.

Figure 2:
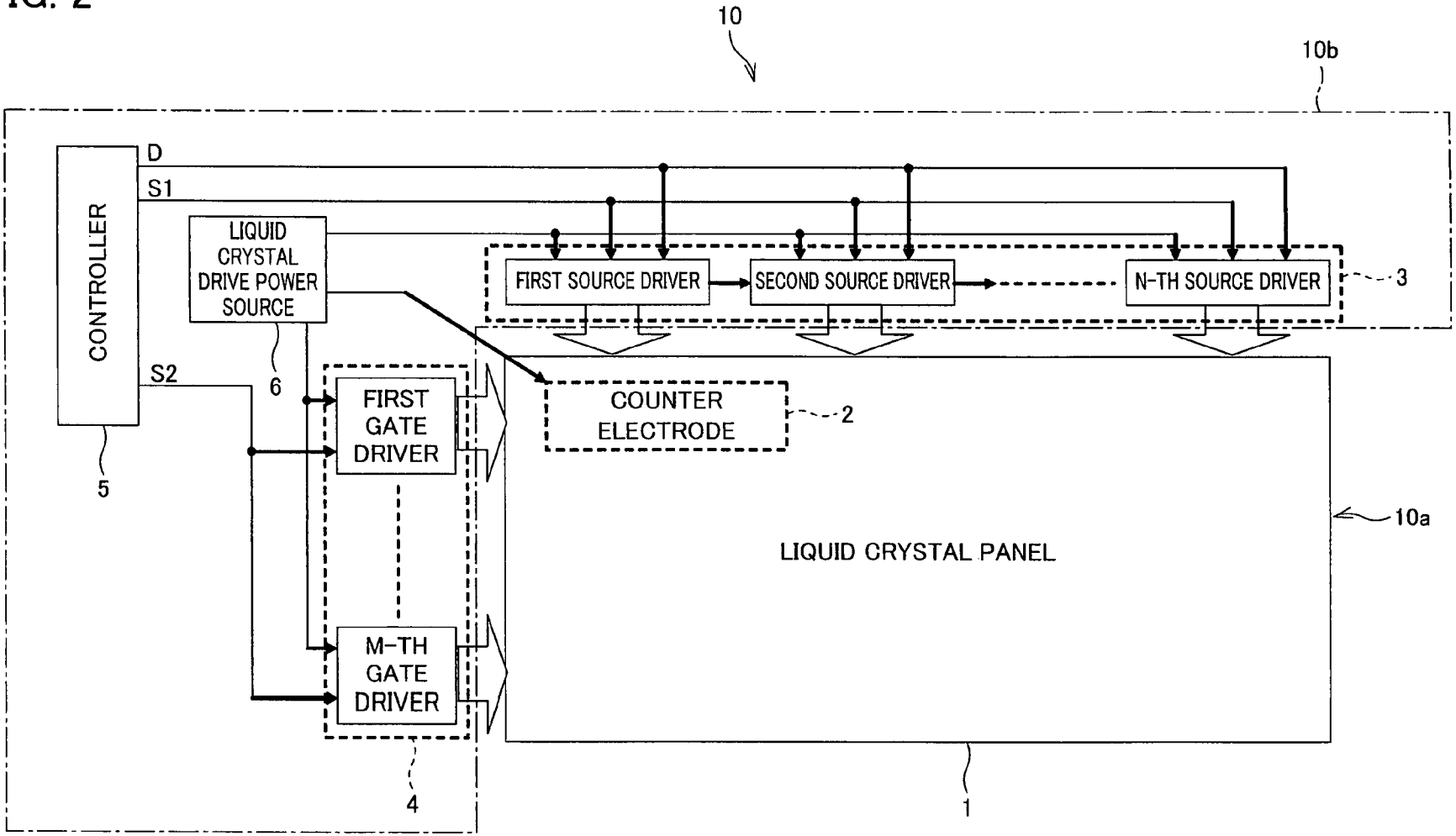
FIG. 2 is a block diagram illustrating an overall structure of a TFT (thin film transistor) liquid crystal display device, a representative example of active-matrix liquid crystal display device, including the display element drive unit.

As illustrated in FIG. 2, a liquid crystal display device 10 as an active-matrix display device of the present embodiment is broadly divided into a liquid crystal display section 10*a* and a liquid crystal drive circuit 10*b* serving as a display element drive unit which drives the liquid crystal display section 10*a*.

The liquid crystal display section 10*a* has a liquid crystal panel 1 as a TFT display panel. The liquid crystal drive circuit 10*b* includes a source driver 3 and a gate driver 4 each of which is realized by IC (Integrated Circuit; semiconductor integrated circuit), a controller 5, and a liquid crystal drive power source 6.

In the liquid crystal display device 10 of the above arrangement, externally supplied display data is supplied as display data D, which is a digital signal, through the controller 5 to the source driver 3. The source driver 3 latches the supplied display data D by time division into first to n-th source drivers. Thereafter, the source driver 3 performs D/A (digital/analogue) conversion on the time-divided display data D into an analogue voltage for grayscale display (hereinafter, referred to as "grayscale display voltage") in synchronism with a horizontal synchronizing signal fed from the controller 5. Then, the source driver 3 outputs the grayscale display voltage via source signal lines (not show) to the respective liquid crystal display elements in the liquid crystal panel 1.

Figure 3:
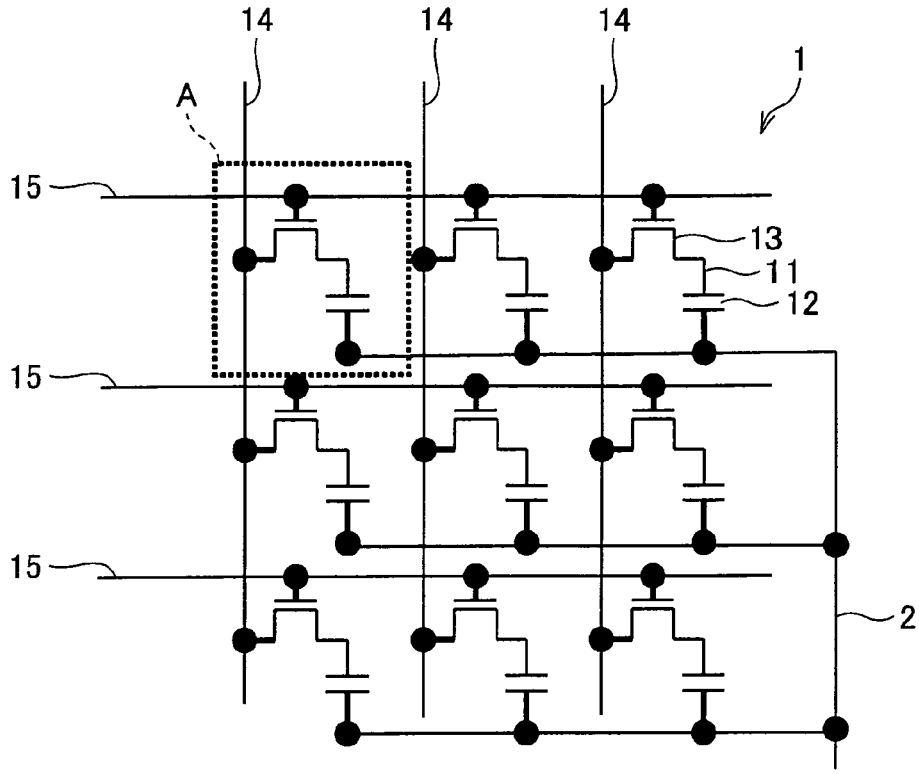
FIG. 3 is a circuit diagram illustrating a structure of a liquid crystal panel of the liquid crystal display device.

Meanwhile, as illustrated in FIG. 3, the liquid crystal panel 1 includes a pixel electrode 11, a pixel capacity 12, a TFT (Thin film Transistor) 13 which performs on/off controls for voltage application to the pixel electrode, a source signal line 14, a gate signal line 15, and a counter electrode 2. Here, the pixel electrode 11, the pixel capacity 12, and the TFT 13 make up a liquid crystal display element A that represents one pixel.

To the source signal lines 14, the grayscale display voltages responsive to luminance levels of target pixels are fed from the source driver 3 illustrated in FIG. 2. To the gate signal lines 15, scanning signals sequentially turning on the TFTs 13 aligned in rows are fed from the gate driver 104. Then, via the ON-state TFT 113, the grayscale display voltage of the source signal line 14 is applied to the pixel electrode 11, which is connected to a drain of the corresponding TFT 13, and the grayscale display voltage is accumulated in the pixel capacity 12, which is provided between the pixel electrode 11 and the counter electrode 2. In this manner, light transmittance of liquid crystal varies with the grayscale display voltage for pixel display.

Next, a n-th source driver 30 that is one of the constituent elements making up the source driver 3 will be described with reference to FIG. 1.

Figure 1:
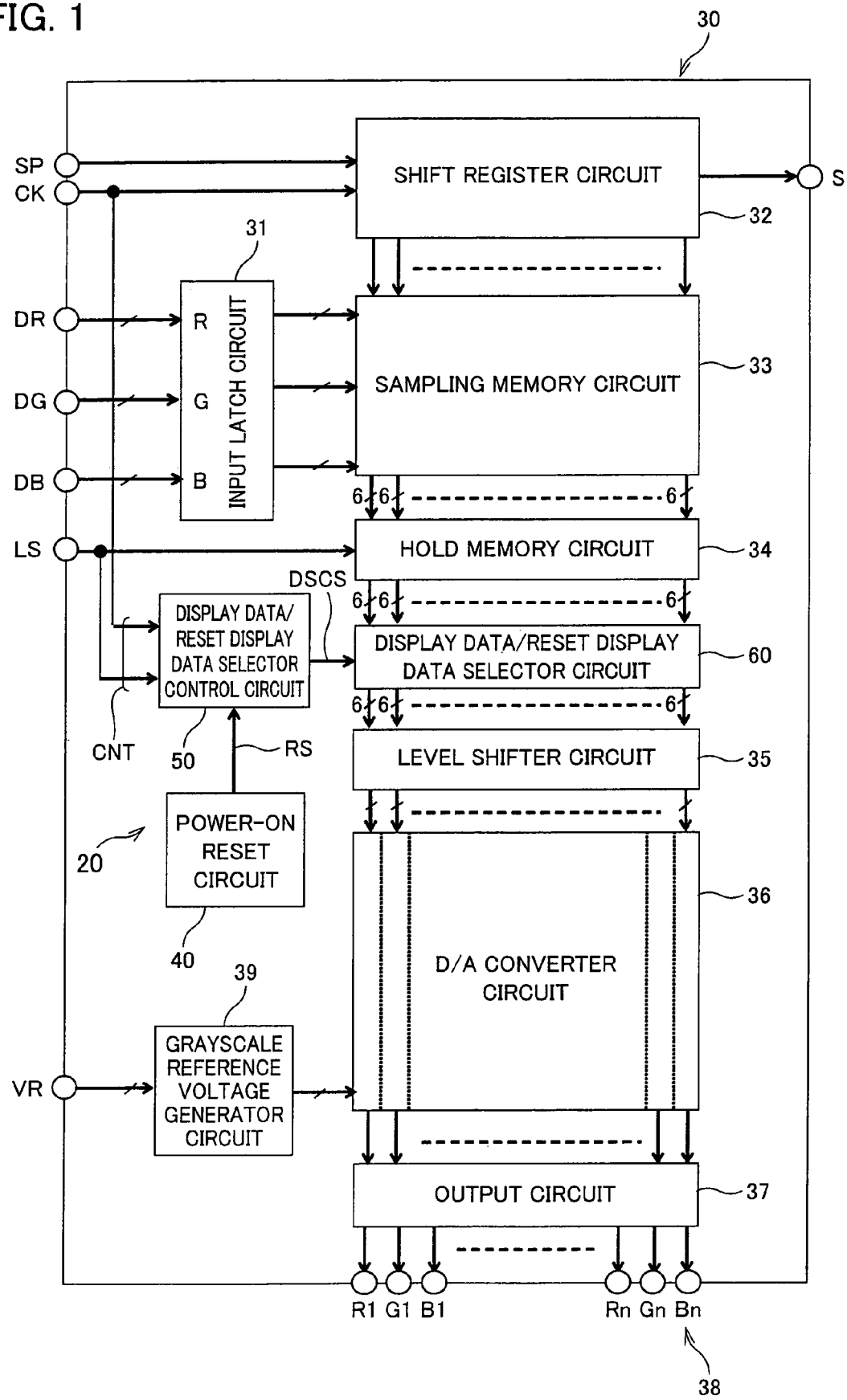
FIG. 1 is a block diagram illustrating one embodiment of a display element drive unit according to the present invention and illustrating the structure of an n-th source driver.
Figure 15:
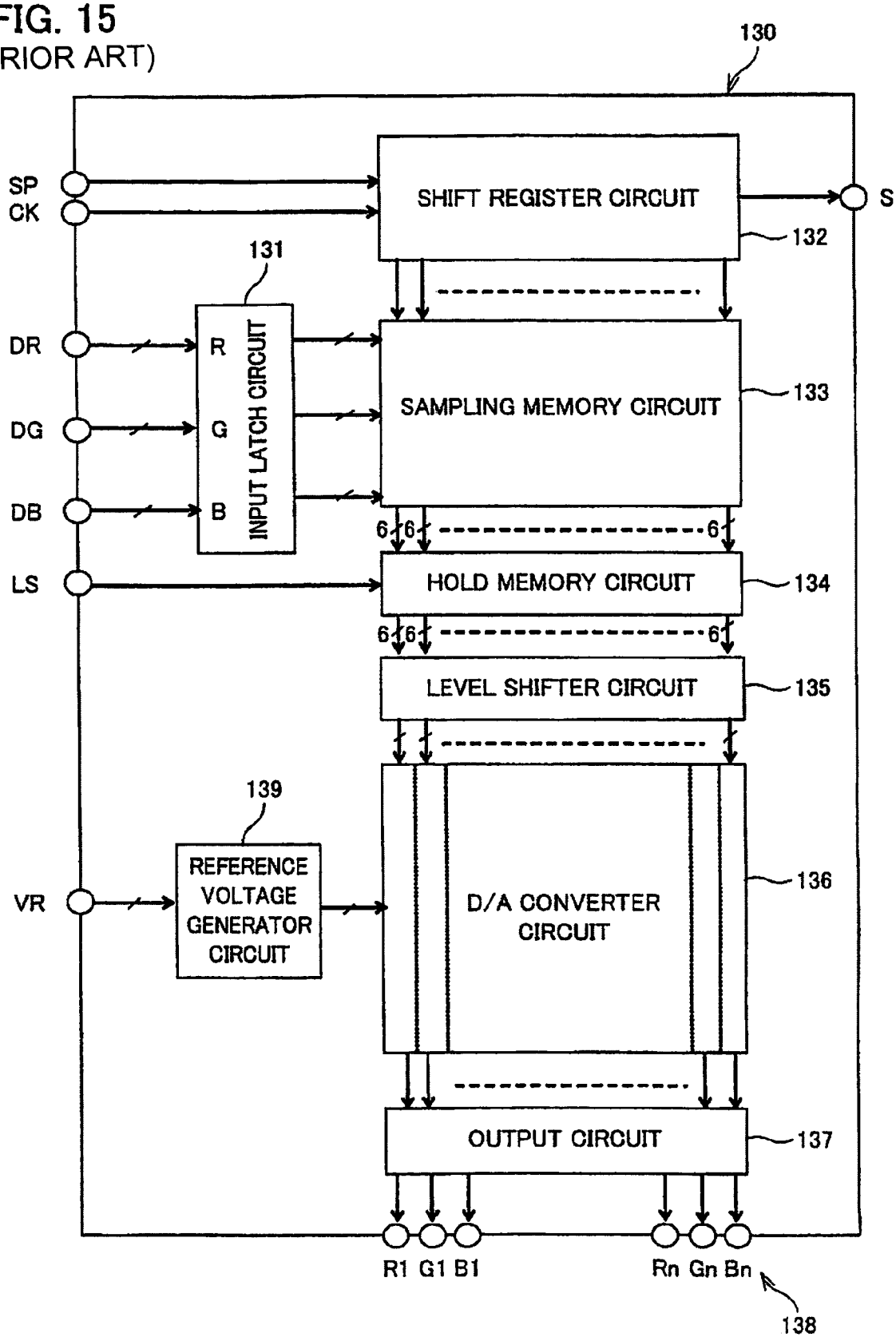
FIG. 15 (PRIOR ART)
FIG. 15 is a block diagram illustrating the structure of an n-th source driver in the liquid crystal display device.
Figure 16:
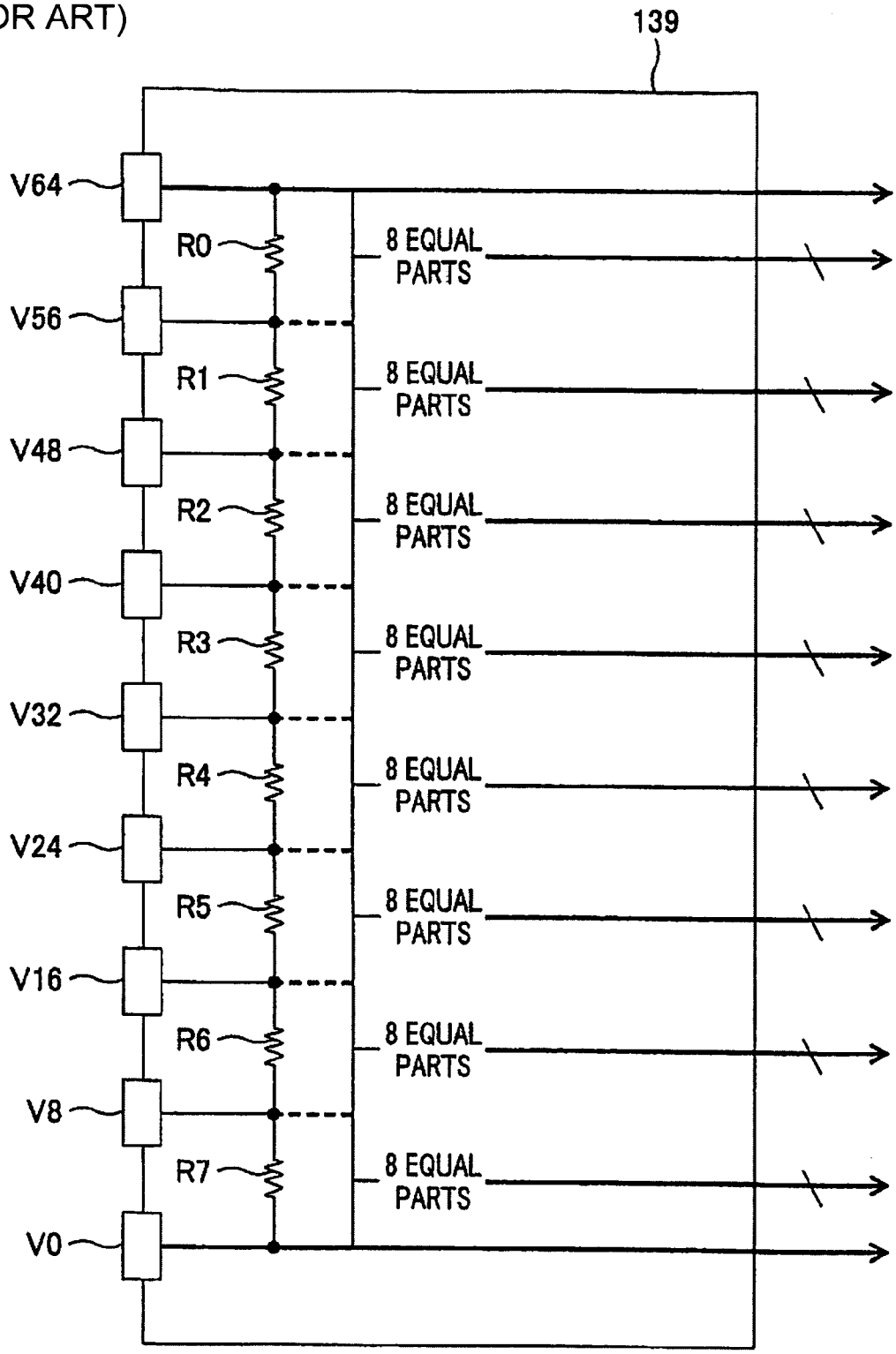
FIG. 16 (PRIOR ART)
FIG. 16 is a block diagram illustrating a resistor division circuit of a reference voltage generator circuit in the n-th source driver.
Figure 17:
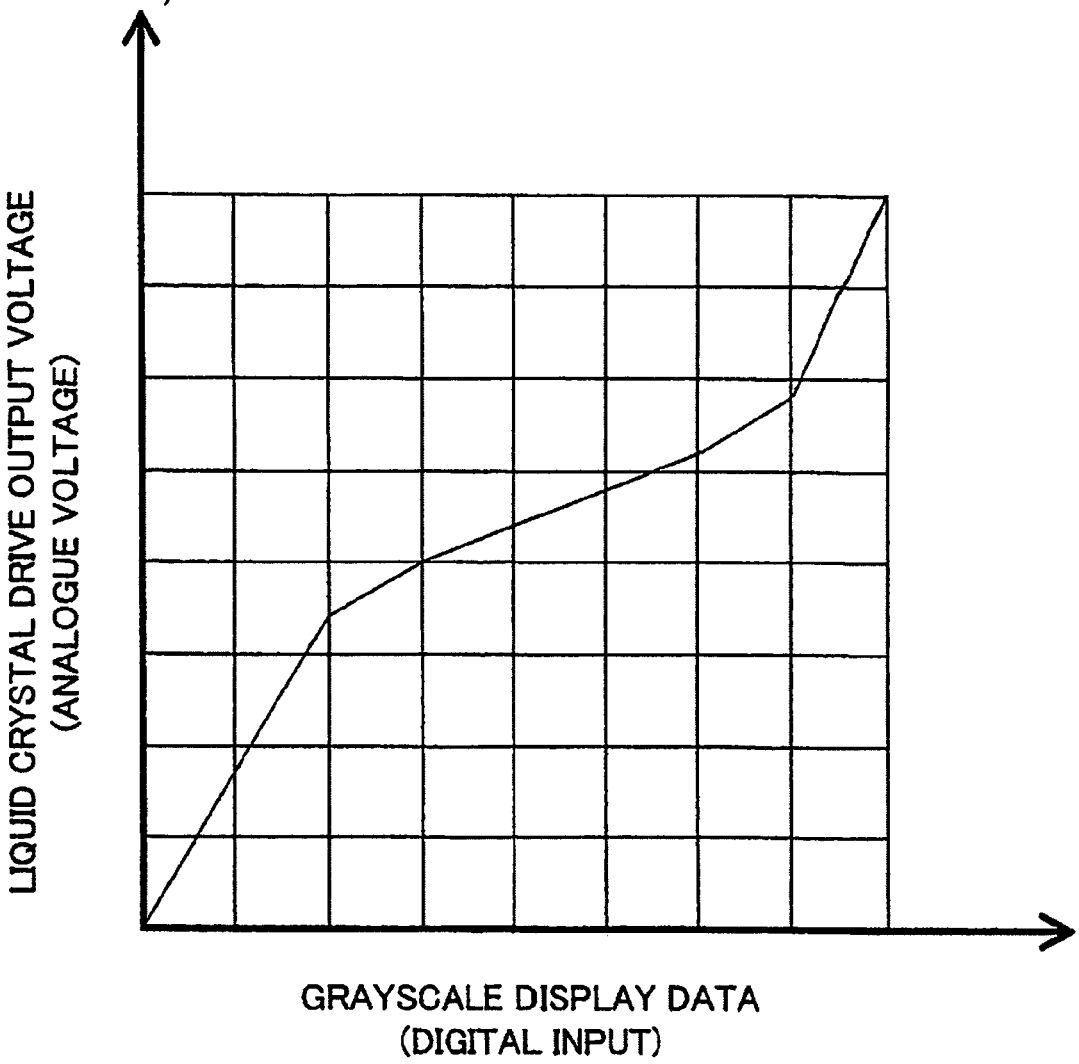
FIG. 17 (PRIOR ART)
FIG. 17 is a graph illustrating a relation between grayscale display data and liquid crystal drive output voltage when γ correction is carried out in the liquid crystal display device.
Figure 18:
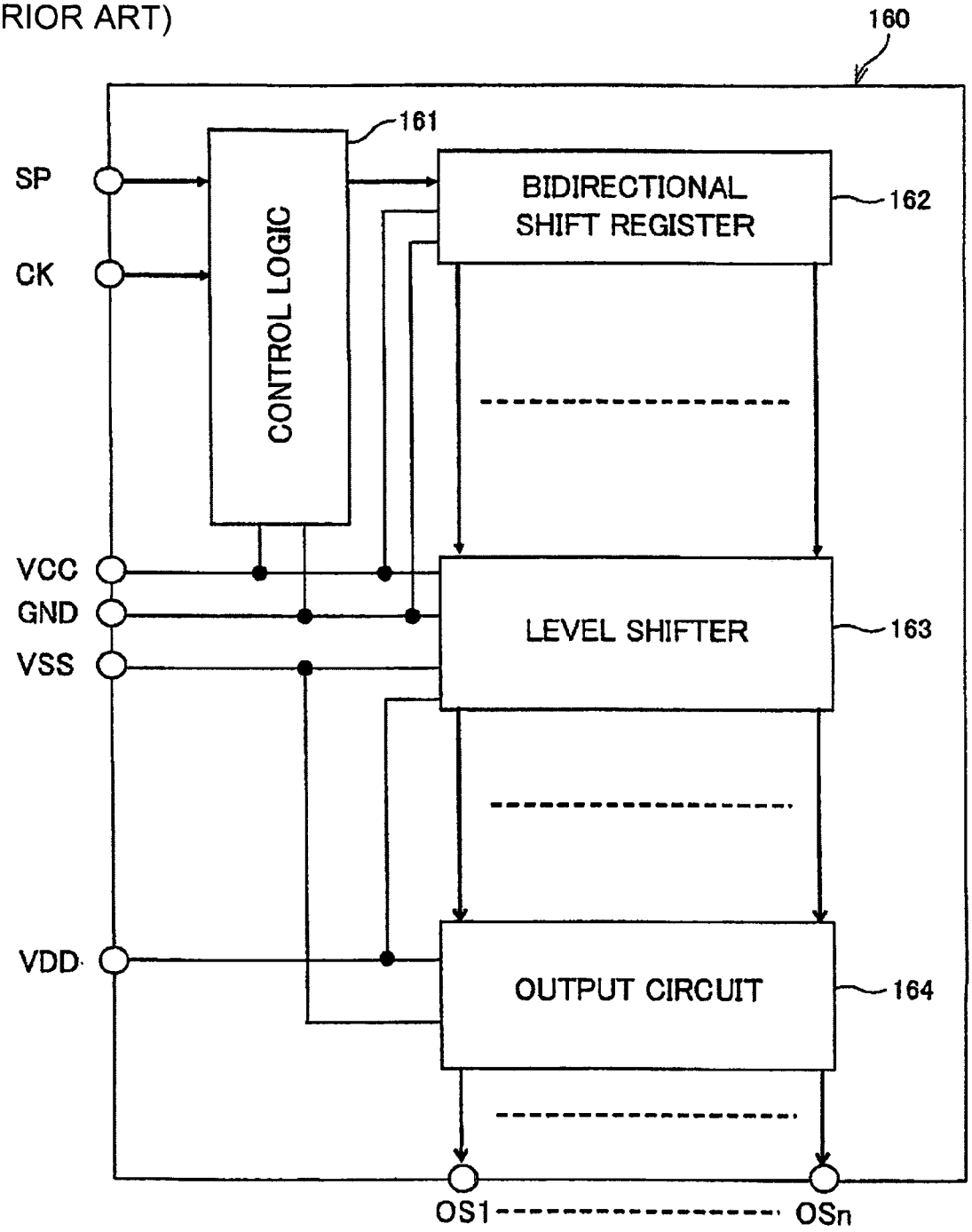
FIG. 18 (PRIOR ART)
FIG. 18 is a block diagram schematically illustrating the structure of a gate driver in the liquid crystal display device.
Figure 19:
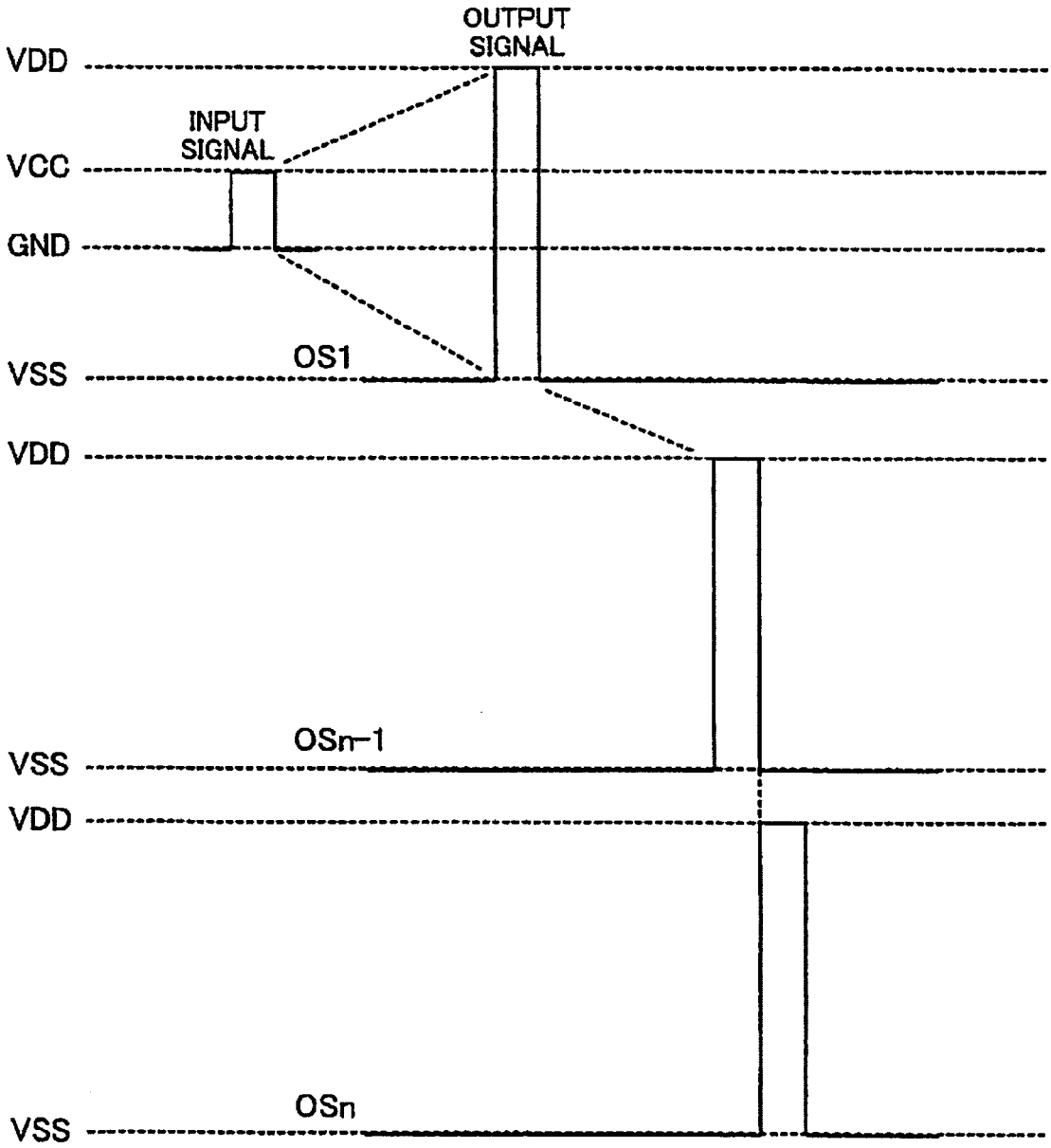
FIG. 19 (PRIOR ART)
FIG. 19 is a timing chart illustrating waveforms of a drive voltage and output in the gate driver.
Figure 20:
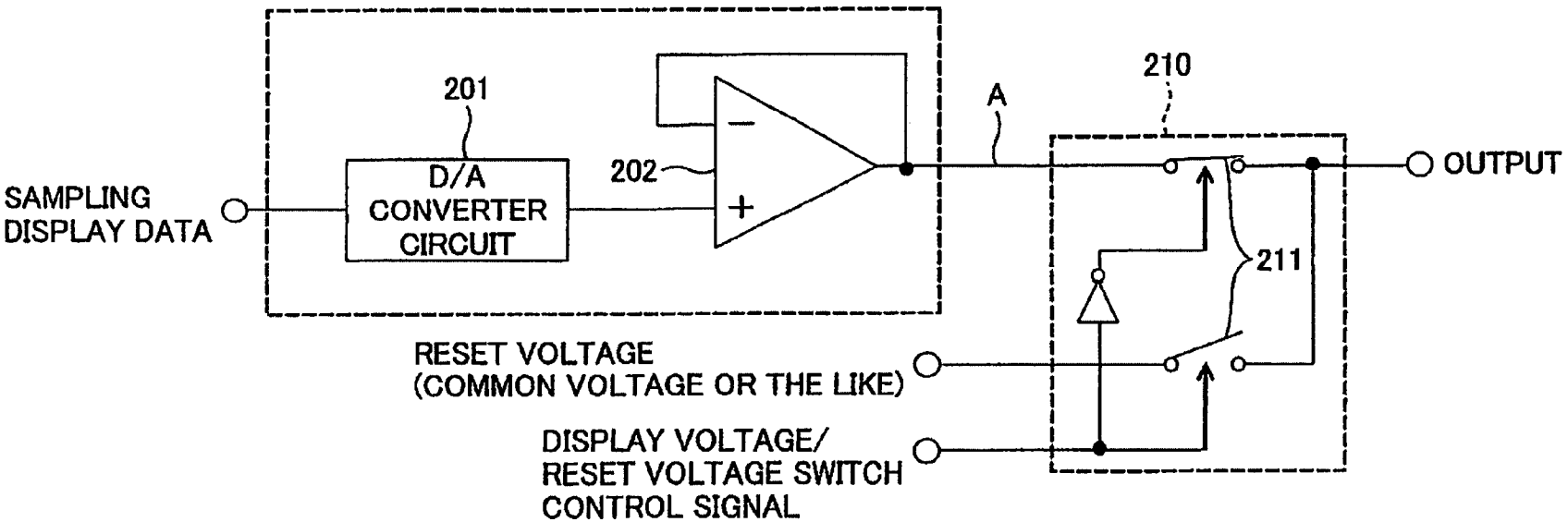
FIG. 20 (PRIOR ART)
FIG. 20 is a block diagram illustrating another conventional display element drive unit including analogue switch means provided between output means and a liquid crystal panel electrode.

As illustrated in FIG. 1, the n-th source driver 30 includes an input latch circuit 31 as latch means, a shift register circuit 32 as transfer means, a sampling memory circuit 33 as sampling memory means, a hold memory circuit 34 as scan data hold means, a level shifter circuit 35 as level shift means, a D/A converter circuit 36 as D/A converting means, an output circuit 37 as output means, a liquid crystal drive voltage output terminals 38 (terminals R1, G1, B1 through Rn, Gn, Bn illustrated in FIG. 1), and a grayscale reference voltage generator circuit 39. This structure is the same as the conventional structure illustrated in FIG. 15.

In the present embodiment, in addition to the conventional structure, a display data/reset display data selector circuit 60 as switch means, a display data/reset display data selector control circuit 50 as switch control means, and a power-on reset circuit 40 as a power-on time judgment means are provided. The display data/reset display data selector circuit 60 is provided between the hold memory circuit 34 and the level shifter circuit 35. The display data/reset display data selector control circuit 50 generates a display data/reset display data selector control signal DSCS for control of the display data/reset display data selector circuit 60. The display data/reset display data selector circuit 60, the display data/reset display data selector control circuit 50, and the power-on reset circuit 40 make up a power-on time display section 20 as power-on time display means of the present invention.

The following will describe details of the power-on reset circuit 40, the display data/reset display data selector control circuit 50, and the display data/reset display data selector circuit 60 in the power-on time display section 20.

Figure 4:
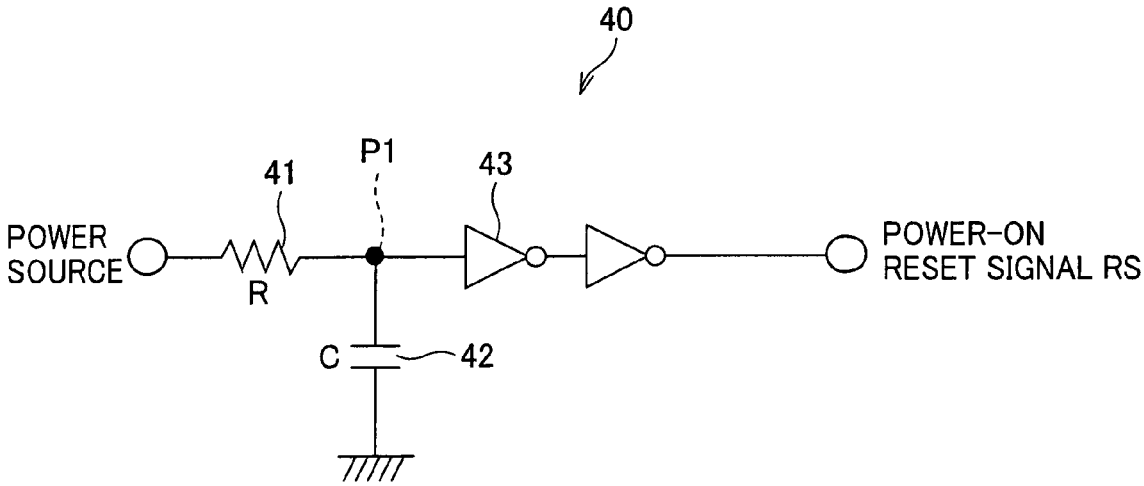
FIG. 4 is a circuit diagram illustrating an equivalent circuit of a power-on reset circuit in the display element drive unit.

First, the structure of the power-on reset circuit 40 is described with reference to FIGS. 4 and 5. As illustrated in FIG. 4, the power-on reset circuit 40 includes a resistor element (R) 41, a capacitor element (C) 42, and an inverter buffer circuit 43.

Figure 5:
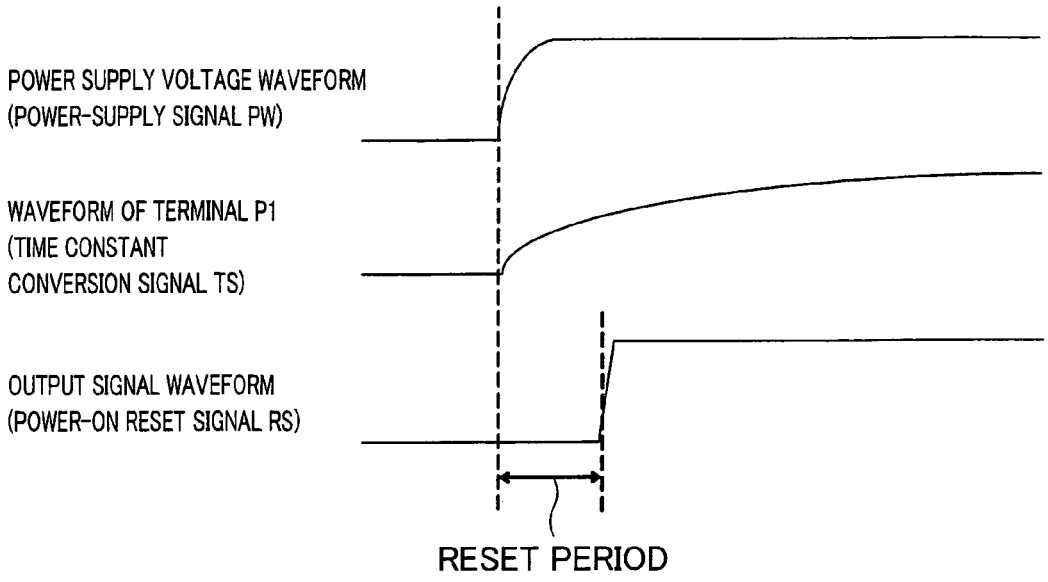
FIG. 5 is a timing chart of input signal, internal signal, and output signal in the power-on reset circuit.

In the power-on reset circuit 40, as illustrated in FIG. 5, the resistor element (R) 41 and the capacitor element (C) 42 convert a power-supply voltage waveform at the power-on into CR time constant, generates a time constant conversion signal TS with a waveform delayed in power rise from an original power-on waveform of a power-supply signal PW, and outputs the time constant conversion signal TS to a terminal P1. The waveform of the time constant conversion signal TS is fed to the inverter buffer circuit 43 for generation of a power-on reset signal RS.

The power-on reset signal RS is a signal having a given reset period right after the power-on and is generated based on (i) the time constant conversion signal TS that is an input signal to the inverter buffer circuit 43 and (ii) a gate voltage threshold value of the inverter buffer circuit 43. The reset period is arbitrarily settable by changing element parameters of the resistor element (R) 41, the capacitor element (C) 42, and the inverter buffer circuit 43. The power-on reset circuit 40 generates the power-on reset signal RS at a power-on timing.

Next, the following will describe the structure of the display data/reset display data selector control circuit 50.

Figure 6:
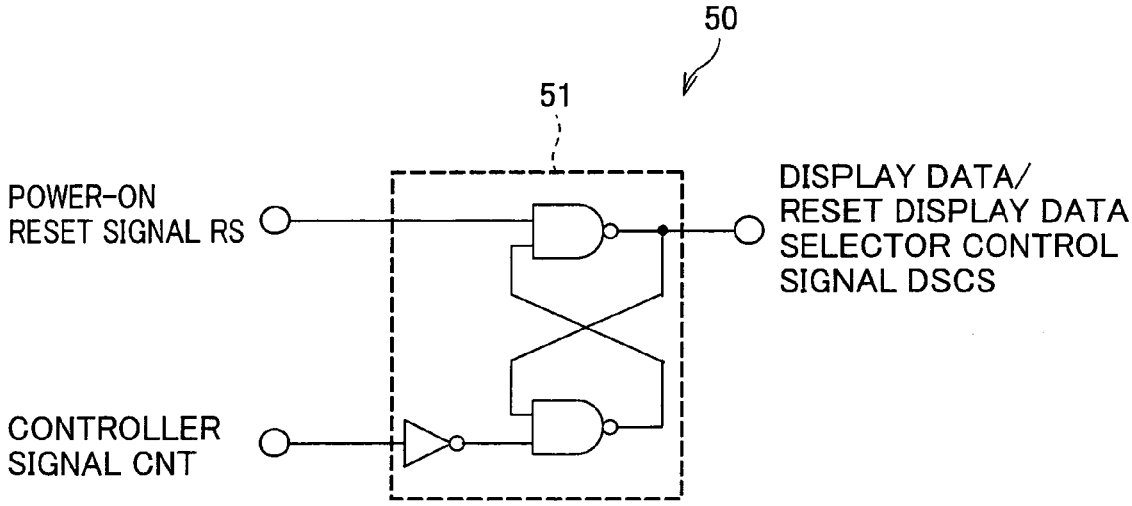
FIG. 6 is a circuit diagram illustrating an equivalent circuit of a display data/reset display data selector control circuit in the display element drive unit.

The display data/reset display data selector control circuit 50, as illustrated in FIG. 6, causes a gate combination circuit section 51 to generate a display data/reset display data selector control signal DSCS based on input signals, the power-on reset signal RS and a control signal CNT. The power-on reset signal RS is a signal generated by the aforementioned power-on reset circuit 40. The controller signal CNT is a control signal supplied from the controller 5 illustrated in FIG. 2 to the n-th source driver 30 illustrated in FIG. 1.

The gate combination circuit section 51 has an inner logical structure varying depending upon a generation timing of the display data/reset display data selector control signal DSCS. In the present embodiment, the gate combination circuit section 51 is adapted so as to generate the display data/reset display data selector control signal DSCS so that reset data is written within a time period between the power-on and first operation of the controller 5.

Figure 7:
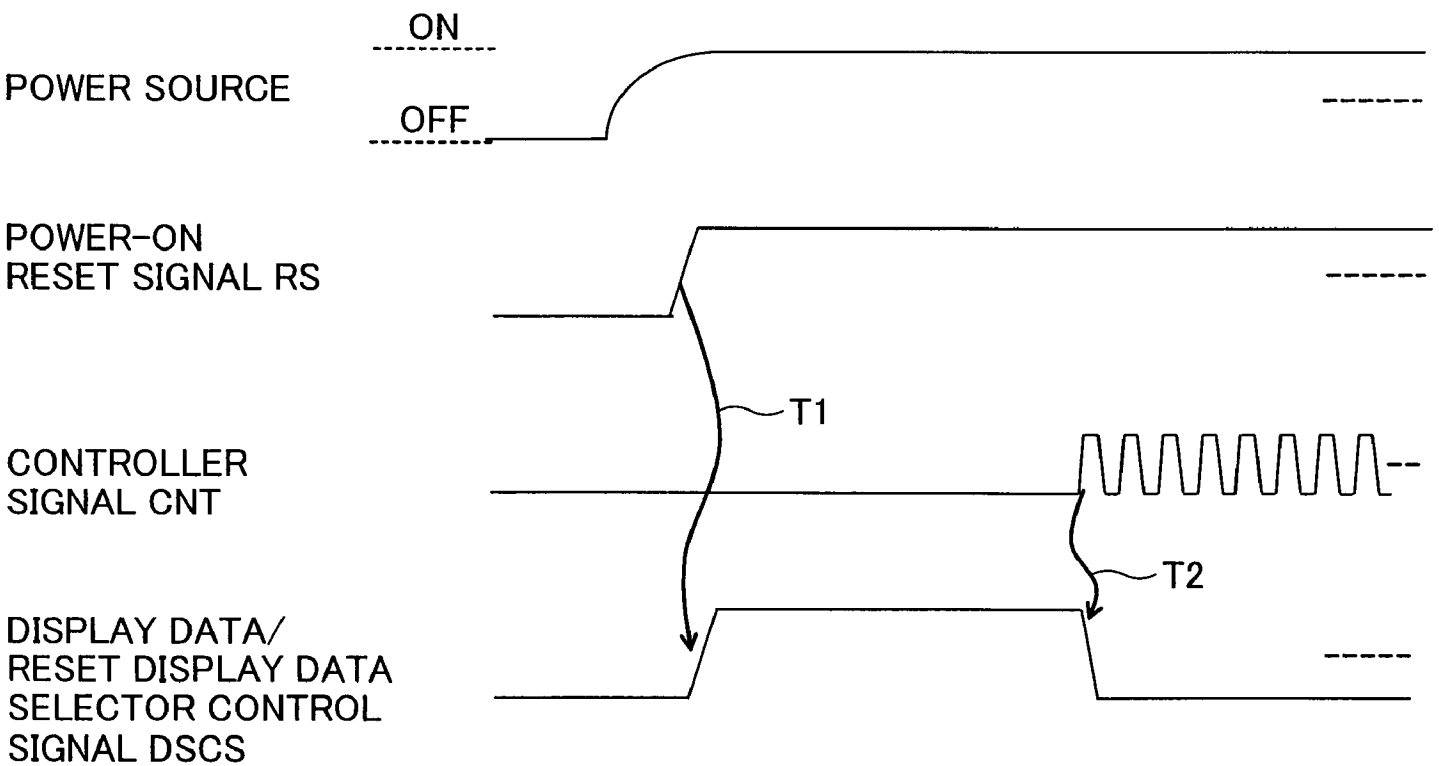
FIG. 7 is a timing chart of input signal, internal signal, and output signal in the display data/reset display data selector control circuit.

In the display data/reset display data selector control circuit 50, as illustrated in FIG. 7, when the gate combination circuit section 51 receives the power-on reset signal RS generated by the power-on reset circuit 40 at the power-on, the display data/reset display data selector control signal DSCS is set to an applied voltage "High" at timing T1.

At timing T2 when operation is initiated by the controller signal CNT, the display data/reset display data selector control signal DSCS is set to an applied voltage "Low".

In this manner, the gate combination circuit section 51 generates the display data/reset display data selector control signal DSCS, which outputs a pulse, within a time period between the power-on and first operation of the controller 5.

Here, the timing T2 when the display data/reset display data selector control signal DSCS is set to an applied voltage "Low" at the first operation of the controller, depends on how long a reset display time, as described later, is required beginning from the power-on. Moreover, for example, change of a timing of the setting to an applied voltage "Low" from the timing when the controller first operates to a timing after the controller signal CNT of plural pulses is supplied, can be realized by change of an internal gate combination in the gate combination circuit section 51.

Next, the structure of the display data/reset display data selector circuit 60 is described with reference to FIG. 8.

Figure 8:
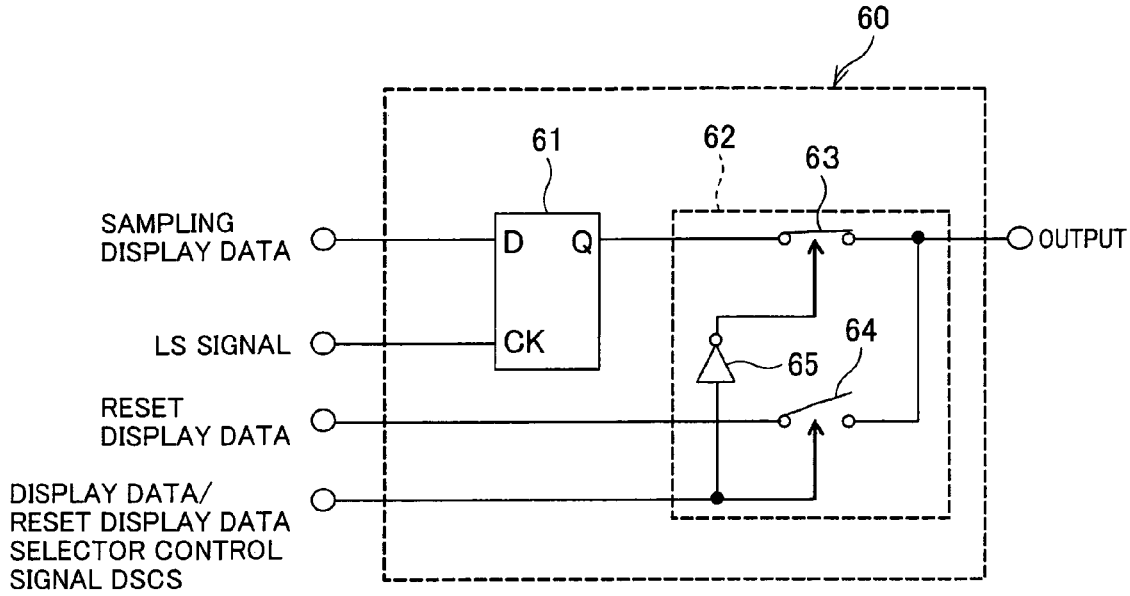
FIG. 8 is a circuit diagram illustrating an equivalent circuit of a display data/reset display data selector circuit in the display element drive unit.

The display data/reset display data selector circuit 60, as illustrated in FIG. 8, is composed of one-bit hold memory circuit 61 and data select circuit 62. The one-bit hold memory circuit 61 is equivalent to memory of the hold memory circuit 34, illustrated in FIG. 1, storing one-bit display data. Usually, the one-bit hold memory circuit 61 is realized by a flip-flop circuit.

Switches 63 and 64 in the data select circuit 62 are equivalent to analogue switches or two-bit multiplexer circuit realized in logical level. When an applied voltage "High" is applied to a gate, one of the switches 63 and 64 is brought into conduction, and the other is brought into out of conduction. The switches 63 and 64 are controlled by the display data/reset display data selector control signal DSCS as a gate voltage or a signal resulting from conversion by inverse logic of an inverter 65. Because of this operation, either the switch 63 or the switch 64 is brought into conduction.

The data select circuit 62 outputs a data signal as a result of switching operation for selecting between (a) the display data stored by normal operation in the one-bit hold memory circuit 61 and (b) reset display data to be displayed during a reset period. The switching operation is controlled by the display data/reset display data selector control signal DSCS.

In the display data/reset display data selector circuit 60, when an applied voltage of the display data/reset display data selector control signal DSCS is set to "Low", the switch 63 is brought into conduction, but the switch 64 is brought out of conduction. With this arrangement, data latched in the one-bit hold memory circuit 61 is selected for output.

On the other hand, an applied voltage of the display data/reset display data selector control signal DSCS is set to "High", the switch 63 is brought out of conduction, but the switch 64 is brought into conduction. With this arrangement, the reset display data is selected for output.

As to setting of the reset display data, a voltage level is preset corresponding to a color displayed in a display reset state. This setting is performed by internally fixed setting or by externally supplied setting.

That is, the following function is provided: the function of selectively outputting display data corresponding to a reset display only in a period during which an applied voltage of the display data/reset display data selector control signal DSCS is set to "High", by using the display data/reset display data selector control signal DSCS generated in a time period between the power-on and first operation of the controller 5 illustrated in FIG. 2.

As to the setting of the reset display data, conversion into a state close to a non-illuminated state of the panel is carried out. That is, for a normally white-mode module, display data on white display or display data on display close to white display is set. For a normally black-mode module, display data on black display or display data on display close to black display is set.

With the display data at the reset time set to these states, display at the power-on of the panel is fixed to a normal state, and an internal data condition is made stable. This initiates the operation without distortions on the display.

Here, as to the method of setting the foregoing reset display data, the following will present specific arrangements of the internally fixed setting and the externally supplied setting.

Figure 9:
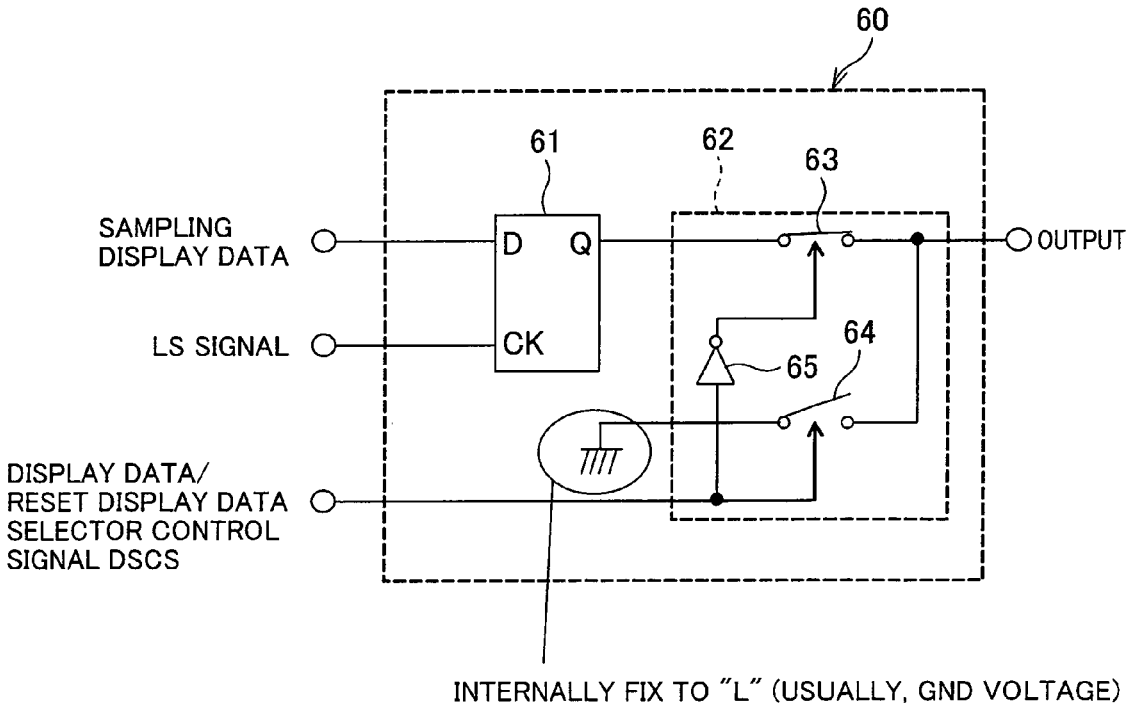
FIG. 9 illustrates a first example of an internally fixed setting of reset display data in the display data/reset display data selector circuit, and is a circuit diagram illustrating an equivalent circuit of a display data/reset display data selector circuit where a base voltage level of a switch is fixed to "Low".
Figure 10:
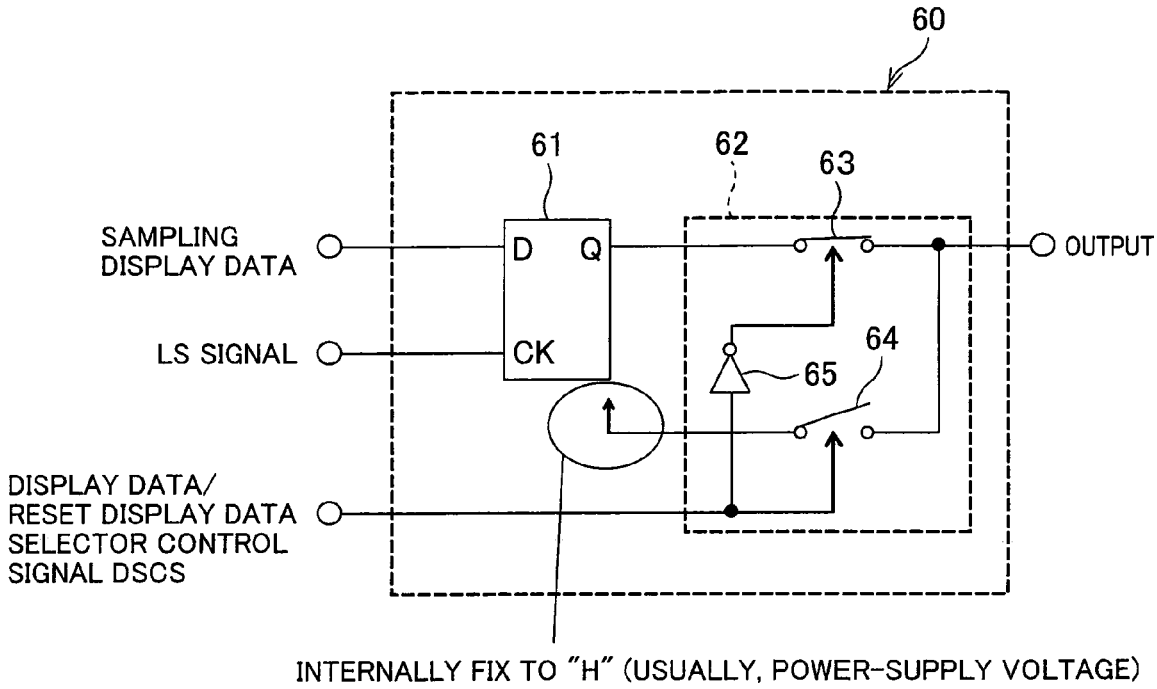
FIG. 10 illustrates the first example of an internally fixed setting of reset display data in the display data/reset display data selector circuit, and is a circuit diagram illustrating an equivalent circuit of a display data/reset display data selector circuit where a base voltage level of a switch is fixed to "High".

First, the following will present two examples for the internally fixed setting. In the present embodiment, it is assumed that data is fixed to display color data in the normal non-illuminated state of the liquid crystal panel 1 during an unstable period right after the power-on. A first example is shown in FIGS. 9 and 10. FIG. 9 illustrates the case when data during the reset period is fixed to "Low". In this case, a black display is provided in the normally white mode. FIG. 10 illustrates the case when data during the reset period is fixed to "High". In this case, a white display is provided in the normally white mode.

As illustrated in FIGS. 9 and 10, fixing to white data, black data, or arbitrary grayscale level data is carried out by fixing a base voltage level of the switch 64 to "Low" or "High". In this fixing, internal setting to "Low" or "High" is realized by fixing to a voltage of internal power source or a substrate.

Figure 11:
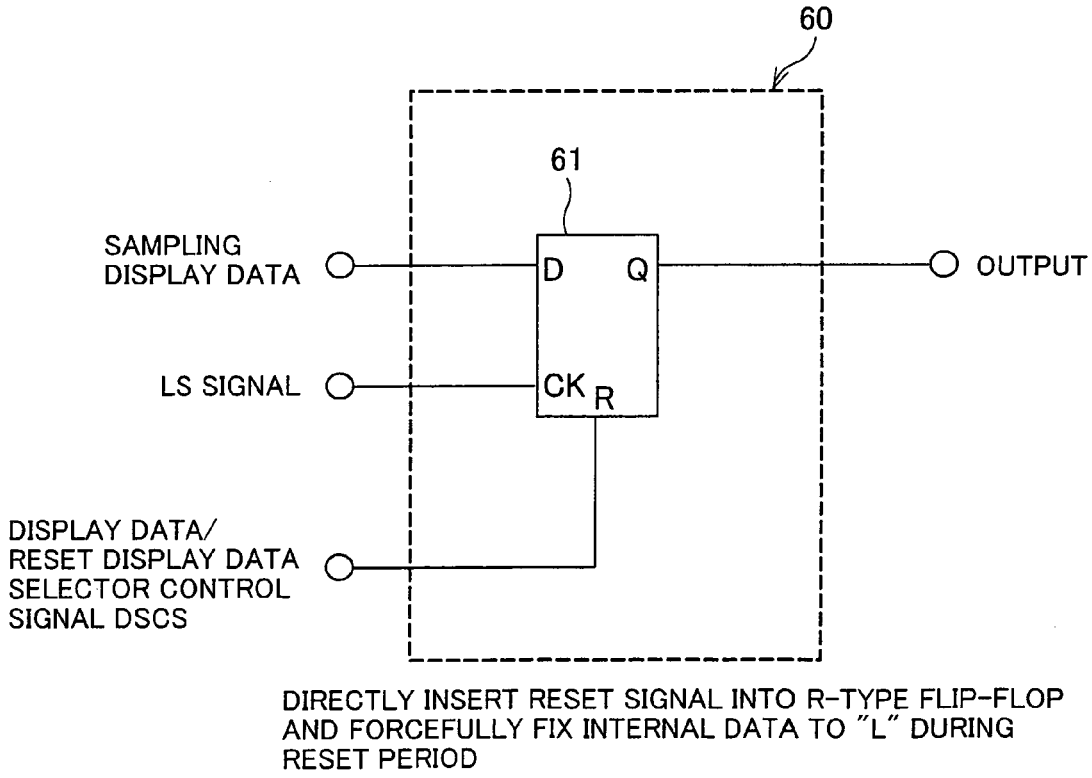
FIG. 11 illustrates a second example of an internally fixed setting of reset display data in the display data/reset display data selector circuit, and is a circuit diagram illustrating an equivalent circuit of a display data/reset display data selector circuit where a base voltage level of a switch is fixed to "Low".
Figure 12:
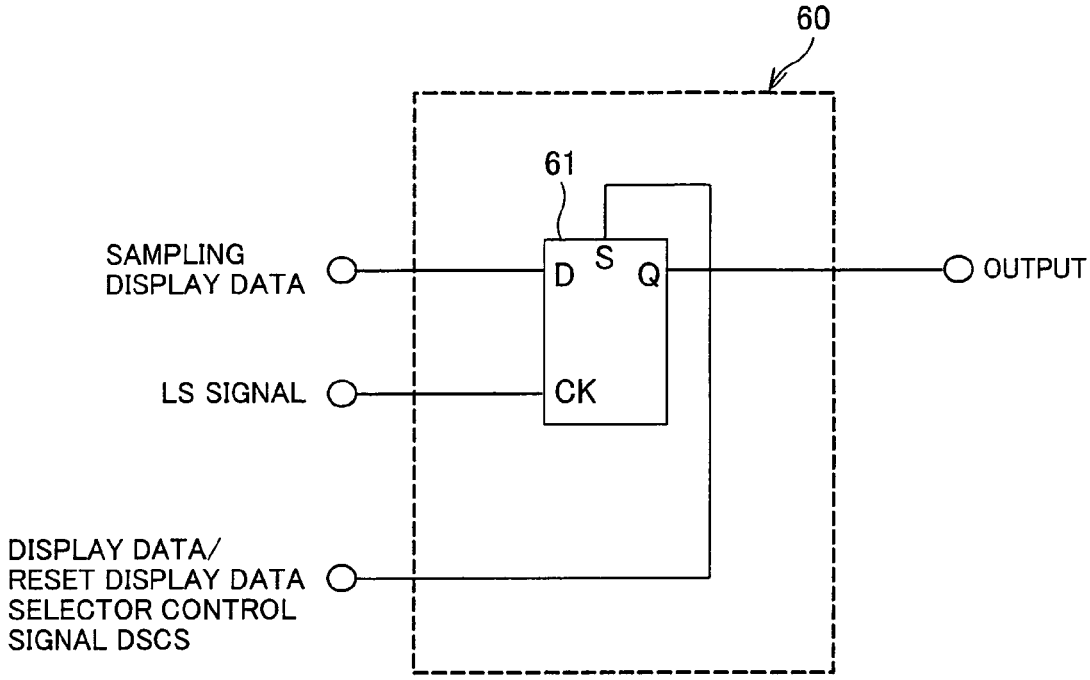
FIG. 12 illustrates the second example of an internally fixed setting of reset display data in the display data/reset display data selector control circuit, and is a circuit diagram illustrating an equivalent circuit of a display data/reset display data selector circuit where a base voltage level of a switch is fixed to "High".
Figure 13:
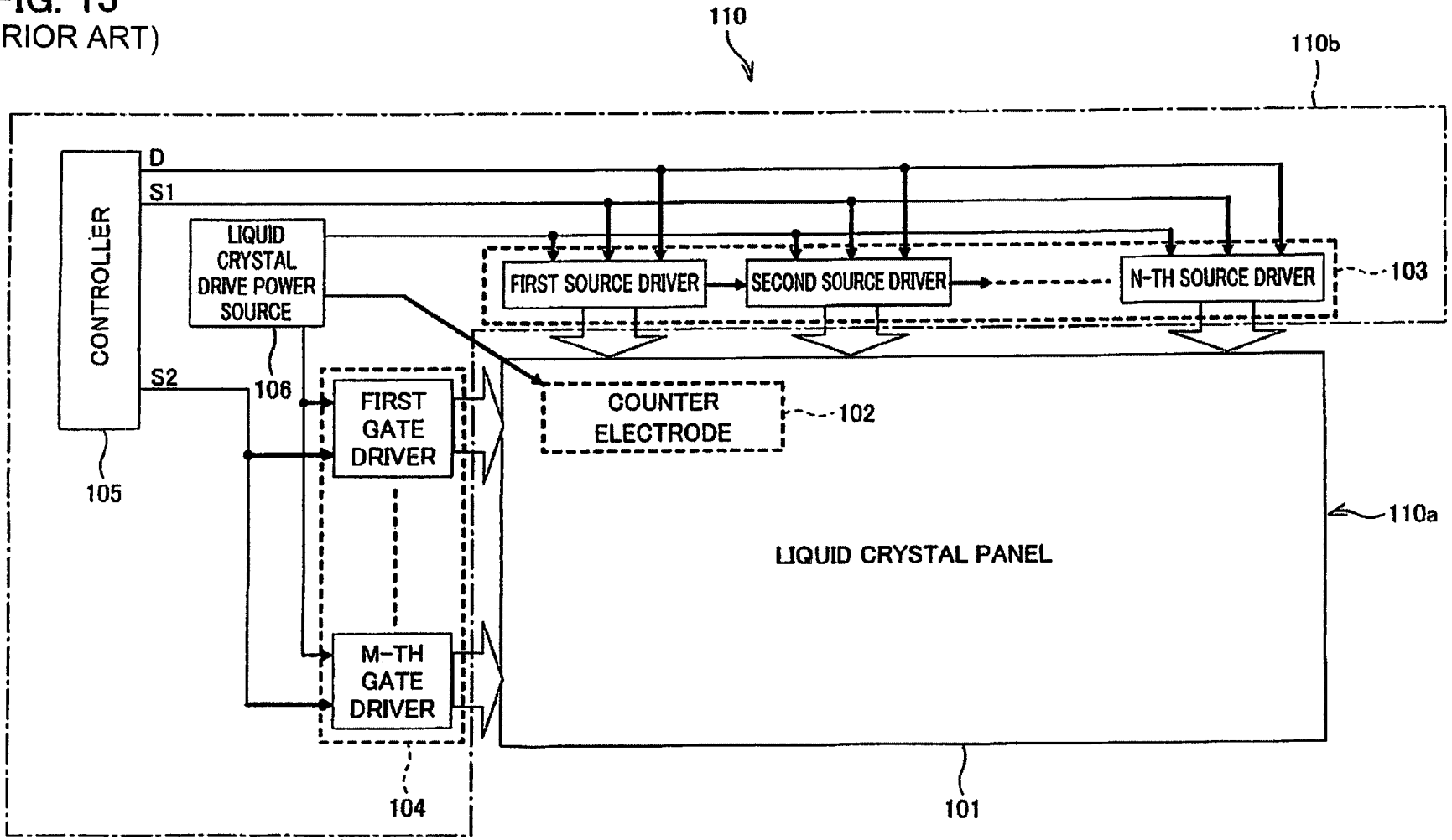
FIG. 13 (PRIOR ART)
FIG. 13 is a block diagram illustrating the structure of the conventional liquid crystal display device.
Figure 14:
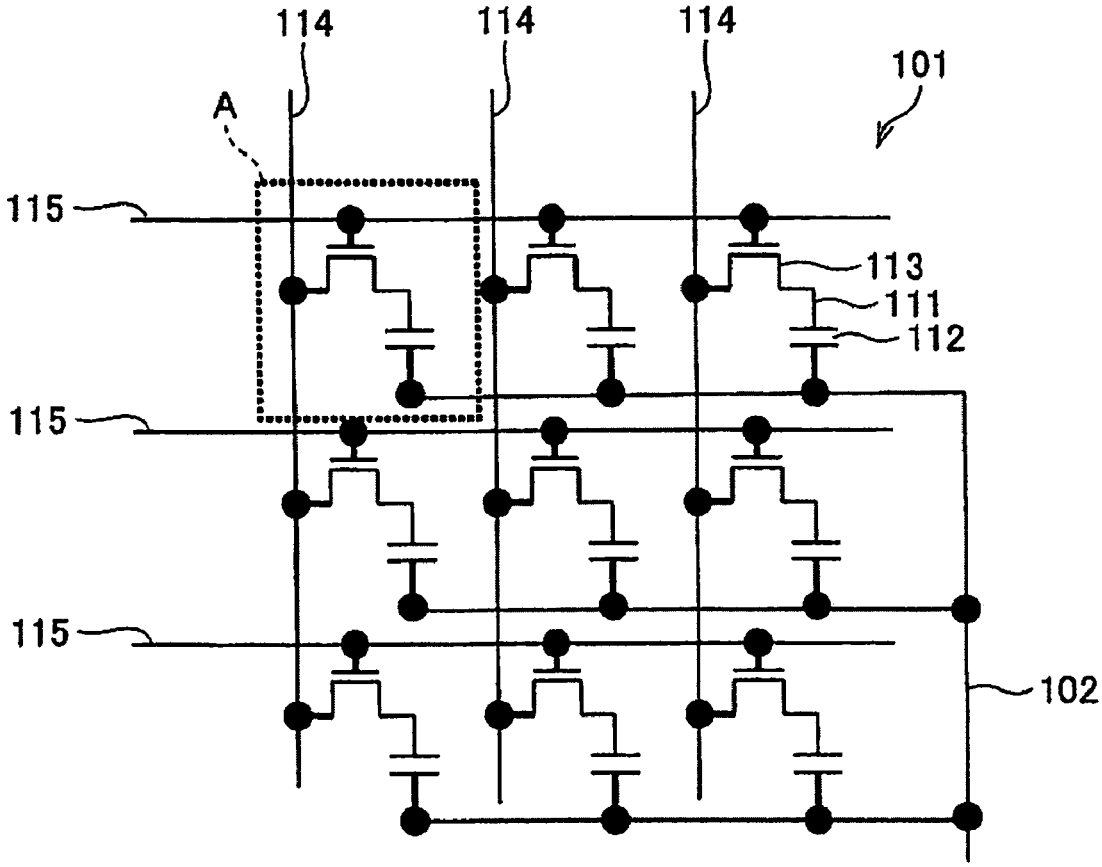
FIG. 14 (PRIOR ART)
FIG. 14 is a circuit diagram illustrating the structure of a liquid crystal panel of the liquid crystal display device.

A second example is shown in FIGS. 11 and 12. FIG. 11 illustrates the case when data during the reset period is fixed to "Low". In this case, a black display is provided in the normally white mode. FIG. 12 illustrates the case when data during the reset period is fixed to "High". In this case, a white display is provided in the normally white mode.

As illustrated in FIGS. 11 and 12, by using a reset signal as a set signal or a reset signal for a S-type (Set) flip-flop or an R-type (Reset) flip-flop, it is possible to directly make the internal memory "Low" or "High" during the period of the reset signal.

In the external setting of non-illuminated state data, it is possible to externally supply the non-illuminated state data to reset data fixing parts (parts indicated by circles in FIGS. 9 and 10) in the ways illustrated in FIGS. 9 and 10.

Further, all of the display data/reset display data selector circuit 60, the display data/reset display data selector control circuit 50, and the power-on reset circuit 40 in the present embodiment are realized by logic circuits. Under a normal operation, the voltage for display is an analogue voltage which is converted from the reset display data. However, in the present embodiment, the reset data at the power-on is controlled by the digital section. Thus, a special voltage for reset, i.e. common voltage, is neither supplied nor used.

Since the analogue display voltage is resulted from the conversion of the reset display data through the D/A converter circuit 36 and the output circuit 37 used under normal operation, the arrangement in which a voltage level that is one of the grayscale display voltage levels is selected is adopted. Therefore, the level shifter circuit 35, the D/A converter circuit 36, the output circuit 37, and the grayscale reference voltage generator circuit 39, all of which are equivalent to the liquid crystal drive system circuit, are realized with the conventional arrangements. Accordingly, it is possible to reduce a circuit scale and reduce terminals count, thus reducing the cost of manufacture.

That is, in the present embodiment, display data/reset display data selector circuit 60, the display data/reset display data selector control circuit 50, and the power-on reset circuit 40, which are provided back of the hold memory circuit 34 and internally generate and switch to a period during which reset is carried out in the non-illuminated state of the panel right after the power-on, are realized by digital circuits.

As a result of this, it is possible to provide (i) the liquid crystal drive circuit 10*b* which easing the problem of a instantaneous display at the power-on and (ii) the liquid crystal display device 10 including the liquid crystal drive circuit 10*b*, by being provided with means for setting an internal scanning signal to grayscale data in the non-illuminated state of the liquid crystal panel 1 (black for the normally black mode and white for the normally white mode) and then outputting the converted voltage for the grayscale display level from the source driver, during a given period at the power-on of the panel.

Thus, in the liquid crystal drive circuit 10*b* of the present embodiment, the power-on time display section 20 presets grayscale display digital data separately to output a grayscale display level voltage, which is different from a grayscale display level voltage based on incoming display data, to a plurality of liquid crystal display elements A during a period between the power-on of the liquid crystal panel 1 and output of the grayscale display level voltage based on the incoming display data.

Therefore, in the present embodiment, the digital section basically fixes the separately preset grayscale display digital data during an unstable display period at the power-on. This makes a circuit configuration designed in a digital manner. Thus, it is possible to design a circuit configuration further smaller than that of switch means realized by an analogue circuit.

The D/A converter circuit 36 is used in the conventional manner, which does not affect drive performance of analogue output.

Consequently, it is possible to provide the liquid crystal drive circuit 10*b* capable of easing an instantaneous display of distorted image that occurs in a given period at power-on of a panel while minimizing increase of a circuit scale; a display element drive method.

In the present embodiment, the power-on time display section 20 is provided in front of the level shifter circuit 35. This arrangement makes the digital section to basically fix the separately preset grayscale display digital data during an unstable display period at the power-on. Consequently, it is possible to minimize a circuit increase by providing the power-on time display section 20 for a low voltage drive section that drives with 3V to 5V power voltage at the previous stage of the level shift section.

The arrangements of the shift register circuit 32 for transferring a start pulse signal based on a clock signal, the input latch circuit 31, the sampling memory circuit 33, the level shifter circuit 35, the D/A converter circuit 36, and the output circuit 37 are the same as the arrangement of the conventional display element drive unit. Therefore, it is possible to solve the problem of an instantaneous display at the power-on while maintaining the installation of the existing periphery components of the panel.

Further, the power-on time display section 20 includes: (a) the power-on reset circuit 40 which judges power-on of the liquid crystal panel 1; (b) the display data/reset display data selector circuit 60 which switches between a separately preset grayscale display digital data and grayscale display digital data based on incoming display data signal; and (c) the display data/reset display data selector control circuit 50 which controls, in accordance with the judgment of power-on by the power-on reset circuit 40, the switch between the separately preset grayscale display digital. data and the grayscale display digital data based on the incoming display data signal performed by the display data/reset display data selector circuit 60. Therefore, it is possible to provide a specific arrangement of the power-on time display section 20.

The D/A converter circuit 36 which carries out digital-analogue conversion is generally realized by the grayscale reference voltage generator circuit 39 and an adjustment amplifier so as to generate a desired intermediate voltage. Therefore, a display voltage at the power-on-is outputted in accordance with the conventional grayscale conversion scheme. Consequently, it is possible to reduce a circuit scale and terminals count, thus reducing the cost of manufacture.

In the liquid crystal drive circuit 10*b* of the present embodiment, the display data/reset display data selector circuit 60 is provided at the subsequent stage of the hold memory circuit 34 which is provided to hold the output of the sampling memory circuit 33 and provided at the previous stage of the level shifter circuit 35.

Therefore, in generating the separately preset display element drive voltage, the present invention provides a solution in such a manner that the conventional liquid crystal drive unit which converts display data into analogue voltage is made to perform switching of display data prior to the analogue conversion. Thus, it is possible to easily solve the problem without increasing a circuit scale.

Further, in the liquid crystal drive circuit 10*b* and the display element drive method of the present embodiment, the display data/reset display data selector control circuit 50 controls switch to display data close to a non-illuminated state of the display elements, as the separately preset grayscale display digital data. Here, the display data close to a non-illuminated state of the display elements is black data in the normally black mode and white data in the normally white mode. With this arrangement, it is possible to bring a display maintaining a power-off state at the power-on.

Still further, in the liquid crystal drive circuit 10*b* of the present embodiment, the display element is a liquid crystal display element A. Therefore, the liquid crystal drive circuit 10*b* which drives the liquid crystal display element A, is capable of easing the problem of an instantaneous display of distorted image that occurs in a given period at power-on of a panel while minimizing increase of a circuit scale.

Yet further, the liquid crystal display device 10 of the present embodiment includes the liquid crystal drive circuit 10*b*. Consequently, it is possible to provide the liquid crystal display device 10 including the liquid crystal drive circuit 10*b* capable of easing the problem of an instantaneous display of distorted image that occurs in a given period at power-on of a panel while minimizing increase of a circuit scale.

As described above, in a display element drive unit of the present invention, the switch means is provided at the subsequent stage of the scanning data hold means which is provided to hold output of the sampling means, and provided at the previous stage of the level shift means.

According to the above invention, the switch means is provided at the subsequent stage of the scanning data hold means which is provided to hold output of the sampling means, and provided at the previous stage of the level shift means.

Therefore, in generating the separately preset display element drive voltage, the present invention provides a solution in such a manner that the conventional liquid crystal drive unit which converts display data into analogue voltage is made to perform switching of display data prior to the analogue conversion. Thus, it is possible to easily solve the problem without increasing a circuit scale.

Further, in a display element drive unit of the present invention, the switch control means controls switch to display data close to a non-illuminated state of the display elements, as a separately preset grayscale display digital data.

Still further, in a display element drive method of the present invention, display data close to a non-illuminated state of the display elements is used as the separately preset grayscale display digital data.

According to the above invention, the switch control means controls switch to the display data close to a non-illuminated state of the display elements, as the separately preset grayscale display digital data. Here, the display data close to a non-illuminated state of the display elements is black data in the normally black mode and white data in the normally white mode.

With this arrangement, it is possible to bring a display maintaining a power-off state at the power-on.

Yet further, in a display element drive unit of the present invention, the display element is a liquid crystal display element.

According to the above invention, it is possible to provide a display element drive unit driving the liquid crystal display element, the display element drive unit capable of easing an instantaneous display of distorted image that occurs in a given period at power-on of a panel while minimizing increase of a circuit scale.

Specific embodiments or examples implemented in the description of the embodiments only show technical features of the present invention and are not intended to limit the scope of the invention. Variations can be effected within the spirit of the present invention and the scope of the following claims.

What is claimed is:

1. A display element drive unit configured to drive a display panel including a plurality of display elements so that the display panel provides a display, the display element drive unit comprising:

a power-on time display device configured to separately presets grayscale display digital data to output a grayscale display level voltage different from a grayscale display level voltage based on incoming display data signal to the display elements during a given period between power-on of the display panel and output of the grayscale display level voltage based on the incoming display data signal, and to supply the grayscale display digital data to a digital-to-analog converter.

2. The display element drive unit according to claim 1, further comprising:

a transfer device configured to transfer a start pulse signal based on a clock signal;

a latch device configured to receive incoming display data signal in synchronism with the clock signal and then outputs the incoming display data signal as synchronization data;

a sampling device configured to sample the synchronization data for output, in accordance with the transferred start pulse signal;

a level shift device configured to increase a voltage of the sampled synchronization data;

a digital-analogue converter configured to carry out digital-analogue conversion of digital data outputted from the sampling means; and an output configured to output a grayscale display-use analogue voltage obtained by the digital-analogue converter to the display elements, the power-on time display device including:

a power-on time judgment device configured to judges power-on of the display panel;

a switch device configured to switch between the separately preset grayscale display digital data and grayscale display digital data based on the incoming display data signal; and a switch control device configured to control, in accordance with the judgment of power-on by the power-on time judgment device, switch between the separately preset grayscale display digital data and the grayscale display digital data based on the incoming display data signal by the switch device.

3. The display element drive unit according to claim 2, wherein:

the switch device is provided at a subsequent stage of a scanning data hold device configured to hold output of the sampling device, and provided at a previous stage of the level shift device.

4. The display element drive unit according to claim 3, wherein:

the switch control device is configured to control switch to display data close to a non-illuminated state of the display elements, as the separately preset grayscale display digital data.

5. The display element drive unit according to claim 4, wherein:

the display element is a liquid crystal display element.

6. The display element drive unit according to claim 3, wherein:

the display element is a liquid crystal display element.

7. The display element drive unit according to claim 2, wherein:

the switch control device is configured to control switch to display data close to a non-illuminated state of the display elements, as the separately preset grayscale display digital data.

8. The display element drive unit according to claim 7, wherein:

the display element is a liquid crystal display element.

9. The display element drive unit according to claim 2, wherein:

the display element is a liquid crystal display element.

10. The display element drive unit according to claim 1, wherein:

the display element is a liquid crystal display element.

11. A display device including a display element drive unit configured to drive a display panel including a plurality of display elements so that the display panel provides a display, the display element drive unit comprising:

power-on time display device configured to separately preset grayscale display digital data to output a grayscale display level voltage different from a grayscale display level voltage based on incoming display data signal to the display elements during a given period between power-on of the display panel and output of the grayscale display level voltage based on the incoming display data signal, and to supply the grayscale display digital data to a digital-to-analog converter.

12. The display device according to claim 11, wherein:

the display element drive unit further comprises:

a transfer device which transfers a start pulse signal based on a clock signal;

a latch device configured to receive incoming display data signal in synchronism with the clock signal and then output the incoming display data signal as synchronization data;

a sampling device configured to sample the synchronization data in accordance with the transferred start pulse signal and then output the sampled synchronization data;

a level shift device configured to increase a voltage of the sampled synchronization data;

a digital-analogue converter device configured to carry out digital-analogue conversion of digital data outputted from the sampling means; and an output configured to output a grayscale display-use analogue voltage obtained by the digital-analogue converter to the display elements, and the power-on time display means includes a power-on time judgment device configured to judge power-on of the display panel;

a switch device configured to switch between the separately preset grayscale display digital data and grayscale display digital data based on the incoming display data signal; and a switch control device configured to control, in accordance with the judgment of power-on by the power-on time judgment device, switch between the separately preset grayscale display digital data and the grayscale display digital data based on the incoming display data signal by the switch device.

13. The display device according to claim 12, wherein:

the switch device of the display element drive unit is provided at a subsequent stage of a scanning data hold device configured to hold output of the sampling means, and to provide at a previous stage of the level shift means.

14. The display device according to claim 13, wherein:

the switch control device of the display element drive unit controls switch to display data close to a non-illuminated state of the display elements, as the separately preset grayscale display digital data.

15. The display device according to claim 14, wherein:

the display element is a liquid crystal display element.

16. The display device according to claim 13, wherein:

the display element is a liquid crystal display element.

17. The display device according to claim 12, wherein:

the switch control device of the display element drive unit controls switch to display data close to a non-illuminated state of the display elements, as the separately preset grayscale display digital data.

18. The display device according to claim 17, wherein:

the display element is a liquid crystal display element.

19. The display device according to claim 12, wherein:

the display element is a liquid crystal display element.

20. The display device according to claim 11, wherein:

the display element is a liquid crystal display element.

21. A display element drive method for driving a display panel including a plurality of display elements so that the display panel provides a display, wherein:

during a given period between power-on of the display panel and output of a grayscale display level voltage based on incoming display data signal, grayscale display digital data is separately preset and converted into analogue grayscale display level voltage to output the analogue grayscale display level voltage to the display elements, and the grayscale display digital data is supplied to a digital-to-analog converter.

22. The display element drive method according to claim 21, wherein:

as the separately preset grayscale display digital data, display data close to a non-illuminated state of the display elements is used.

* * * * *